US005509593A

United States Patent [19]

Bloch et al.

[11] Patent Number: 5,509,593

[45] Date of Patent: Apr. 23, 1996

[54] COMBINED WET AND DRY SANITARY TISSUE DISPENSER

[75] Inventors: Nathan D. Bloch, Cherry Hill; Edward J. O'Brien, Eastampton, both of N.J.

[73] Assignee: Scott Paper Company, Delaware County, Pa.

[21] Appl. No.: 181,730

[22] Filed: Jan. 18, 1994

[51] Int. Cl.[6] ..... A47K 10/32

[52] U.S. Cl. ..... 225/37; 225/34; 225/39; 225/45; 225/46; 225/80; 225/106; 221/34; 242/593; 242/594.5

[58] Field of Search ..... 225/7, 34, 35, 225/36, 37, 38, 39, 40, 42, 45, 46, 77, 80, 106; 221/34, 199; 242/593, 594.5

[56] References Cited

U.S. PATENT DOCUMENTS

| | | | |
|---|---|---|---|
| 2,482,714 | 9/1949 | Mell | 225/38 |
| 2,722,387 | 11/1955 | Tuttle | 225/38 |
| 2,858,086 | 10/1958 | Saphier | 225/38 |
| 2,943,777 | 7/1960 | Dvoracek | 225/38 |
| 3,523,653 | 8/1970 | Hansen | 242/593 |
| 3,982,659 | 9/1976 | Ross | 225/106 X |
| 3,986,479 | 10/1976 | Bonk | 225/106 X |
| 4,645,107 | 2/1987 | Norris | 225/38 X |
| 4,648,530 | 3/1987 | Granger | 221/34 |
| 4,811,878 | 3/1989 | Horinchi | 225/46 |
| 4,872,601 | 10/1989 | Sigmund | 225/38 |
| 5,172,840 | 12/1992 | Bloch et al. | 225/34 X |

FOREIGN PATENT DOCUMENTS

| | | | |
|---|---|---|---|
| 128127 | 12/1984 | European Pat. Off. | 242/593 |
| 461930 | 11/1913 | France | 221/199 |

*Primary Examiner*—Richard K. Seidel
*Assistant Examiner*—Clark F. Dexter
*Attorney, Agent, or Firm*—Woodcock Washburn Kurtz Mackiewicz & Norris

[57] ABSTRACT

A combined dry sanitary tissue and prewetted personal hygiene wipes dispenser including a rear housing and a front housing, the front housing being movable from an open position to a closed position with the rear housing, the front and rear housings forming a first compartment for a roll of dry sanitary tissue, the compartment having an opening through which the roll of dry sanitary tissue is dispensed. A second compartment is provided inside the first compartment from which a roll of prewetted personal hygiene wipes is dispensed. The second compartment includes a lid having a dispensing port therethrough. There is an orifice through the front housing allowing access to the dispensing port in the lid when the front housing section is in the closed position. The lid is not removable from the second compartment when the front housing is in the closed position. A lock is included for locking the front housing in the closed position. In such manner, neither the roll of dry sanitary tissue nor the roll of prewetted personal hygiene wipes is subject to theft.

13 Claims, 4 Drawing Sheets

COMBINED WET AND DRY SANITARY TISSUE DISPENSER

BACKGROUND OF THE INVENTION

1. Field of the Invention

The present invention relates generally to dispensing of rolled sanitary tissue products, and more particularly, to a sanitary tissue dispenser which dispenses both dry sanitary tissue and wet wipe sheets for personal hygiene.

2. Brief Description of the Prior Art

Numerous sanitary tissue dispensers are known in the prior art, both for home and public use. Personal hygiene wet wipes, on the other hand, tend to be a consumer product for use in the home. Typically, personal hygiene wet wipes are packaged in molded or vacuum formed disposable plastic containers which are also intended to serve as the dispenser for the wet wipes until the container is empty. In the home, such containers are generally placed on the top of the tank of the toilet or on some other surface in close proximity to the toilet so that they are easily reachable. Personal hygiene wet wipes are generally not supplied in public restrooms. Placing unsecured packages of wet wipes in a public restroom creates the potential problems of theft, a perception that the product may be unsanitary as having been touched by the previous user, and a perception that the product may have been subject to tampering.

There are a few add on dispensers known in the prior art where a separate wet wipe dispenser has been designed to be attached to or supported by an existing dry sanitary tissue dispenser. One such dispenser is taught in U.S. Pat. No. 3,837,595 to Boone. Boone teaches a cylindrical dispenser having a slot opening wherein the dispenser is supported on arms which attach to the spindle of the existing dry tissue dispenser. In the alternative, Boone teaches an add on ceramic support bracket to match the existing home ceramic dry tissue support bracket. A container of rolls of wetted sheets is supported from this add-on support bracket.

U.S. Pat. No. 4,106,616 to Boone depicts yet another conventional toilet tissue dispenser as would typically be found in the home. From this dry tissue dispenser, Boone teaches various forms of wet wipe containers which, through the use of a support arm, can be attached and supported from the spindle of the dry tissue dispenser.

U.S. Pat. No. 4,834,316 to DeLorean teaches an auxiliary bathroom tissue dispenser having brackets adapted to be supported from the spindle of an existing dry tissue dispenser. The auxiliary bathroom tissue dispenser supports a second roll of dry tissue and includes a platform on which to rest a conventional wet tissue dispenser.

The prior art fails to teach or suggest a combined dry tissue dispenser and pre-wetted personal hygiene wiper dispenser which obviates the potential for theft of the wet wipe web. In addition, this prior art does not teach a combined wet/dry dispenser which reduces the perception that the product may have been touched by a prior user and therefore is unsanitary, and further, reduces the perception that the wet wipe web may have suffered from product tampering.

SUMMARY OF THE INVENTION

It is therefore an object of the present invention to provide a combined dispenser for dispensing dry sanitary tissue and pre-wetted personal hygiene wet wipes from a single fixture.

It is the further object of the present invention to provide a combined dispenser for dispensing sanitary tissue and pre-wetted personal hygiene wipers wherein the dispenser is lockable such that the products contained therein are not subject to gross theft of entire rolls thereof.

It is yet another object of the present invention to provide a dispenser for dispensing dry sanitary tissue and pre-wetted personal hygiene wipers wherein the public can be confident that the pre-wetted personal hygiene wipers have not been handled by prior users with the possible exception of the first pre-wetted wiper that is delivered to each individual user.

Still another object of the present invention is to provide a dispenser for dispensing dry sanitary tissue and pre-wetted personal hygiene wipers predominantly for use in public restrooms wherein there is a reduced perception that the pre-wetted personal hygiene wipers may have been subject to product tampering.

These and other numerous features, objects and advantages of the present invention will become readily apparent upon reading the detailed description, claims and drawings set forth hereinafter. Briefly stated, these features, objects and advantages are accomplished by providing a single housing which includes support means for a roll of dry sanitary tissue and a separate roll of pre-wetted personal hygiene wipers wherein the housing includes a front cover section which is lockable to the remainder of the housing. The housing includes a dispensing opening in the base thereof for the dispensing of dry sanitary tissue. Further, there is an opening in the housing through which the pre-wetted personal hygiene wipers are dispensed. The dispenser housing may include an attached cylindrical container or compartment into which the roll of pre-wetted personal hygiene wipers is inserted and for which a separate lid is provided, the separate cover maintaining a liquid tight seal with the cylindrical container. The front cover of the housing mounts such that the opening therethrough proximate to where the wet wipes reside is in alignment with the lid for the wet wipes with the opening in the front cover having a smaller diameter than the lid for the wet wipes. In such manner, wet wipes may be extracted through a dispensing orifice in the wet wipe cover by a user. However, a normal user will not be able to remove the wet wipe cover without first unlocking and opening the front cover of the dispenser housing.

In the alternative, instead of having a cylindrical container affixed to the housing into which a roll of pre-wetted personal hygiene wipers are inserted, the dispenser housing may be provided with support members for supporting a disposable wet wipe package such as that taught in U.S. Pat. Nos. Des. 295,831 and Des. 273,843. Such support members may be in the form of posts or cradles or combinations thereof projecting from the walls of the housing.

DETAILED DESCRIPTION OF THE PREFERRED EMBODIMENT

Figure 3:
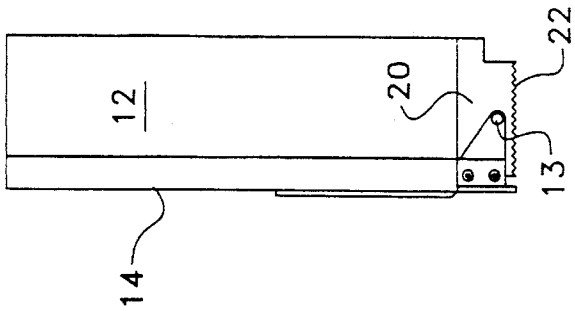
FIG. 3 is a side elevational view of the dispenser shown in FIG. 1.
Figure 1:
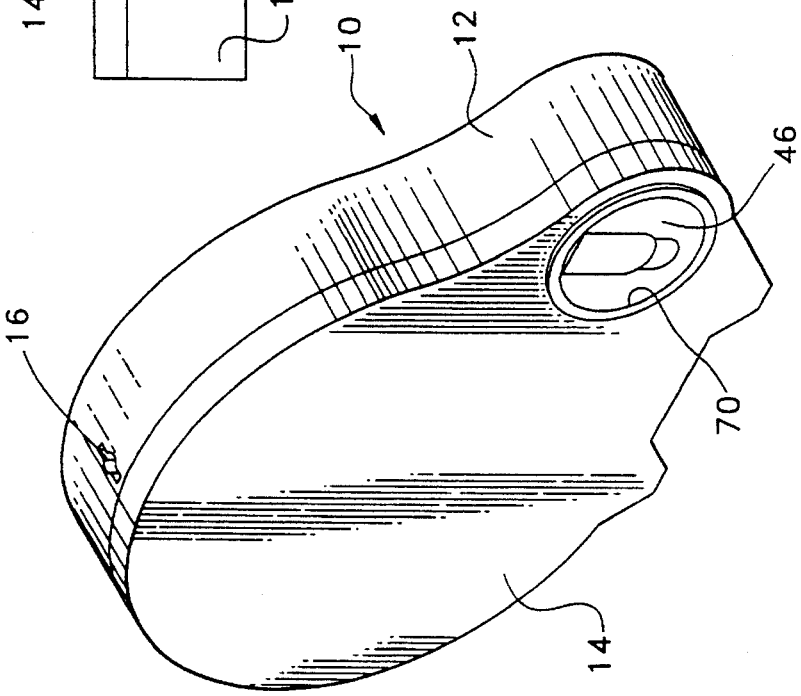
FIG. 1 is a perspective view of the dispenser of the present invention.

Turning first to FIG. 1 there is depicted the combined dry sanitary tissue and pre-wetted personal hygiene wiper dispenser 10 of the present invention. The dispenser includes a rear housing section 12 and a front housing section 14. The front housing section 14 is preferably pivotally mounted to rear housing section 12 at the base thereof at hinge pins 13 (see FIG. 3) such that front housing section 14 can be pivoted downward away from rear housing section 12 when it is necessary to perform maintenance to the dispenser 10 such as refilling it with sanitary tissue or personal hygiene wet wipes. Alternatively, rather than being pivotally mounted to rear housing section 12, front housing section 14 may be completely disengageable from rear housing section 12.

Figure 4:
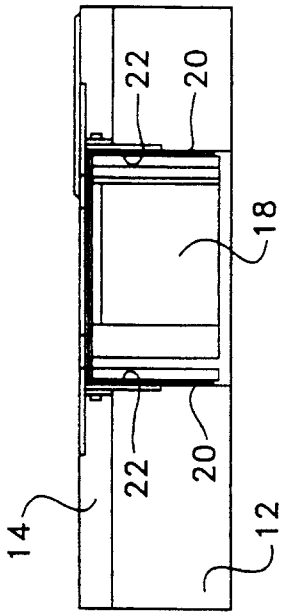
FIG. 4 is a bottom plan view of the dispenser shown in FIG. 1.

A keyway 16 is provided providing key access to a conventional locking device located thereunder as may be typically used in commercial dispensers and as is well known to those skilled in the art. In such manner, without a key, access to the interior of the dispenser 10 for the purpose of removing or installing entire rolls of dry sanitary tissue or personal hygiene wet wipes is prevented. At the base of dispenser 10 is a dispensing opening 18 (see FIG. 4) through which dry sanitary tissue is dispensed. On each side of dispensing opening 18, there are vertical wall sections 20. Each vertical wall section 20 has a bottom edge 22 to facilitate tearing of the dry sanitary tissue once a user has withdrawn the desired length through dispensing opening 18. Bottom edges 22 may be serrated to facilitate tearing of the web.

Figure 5:
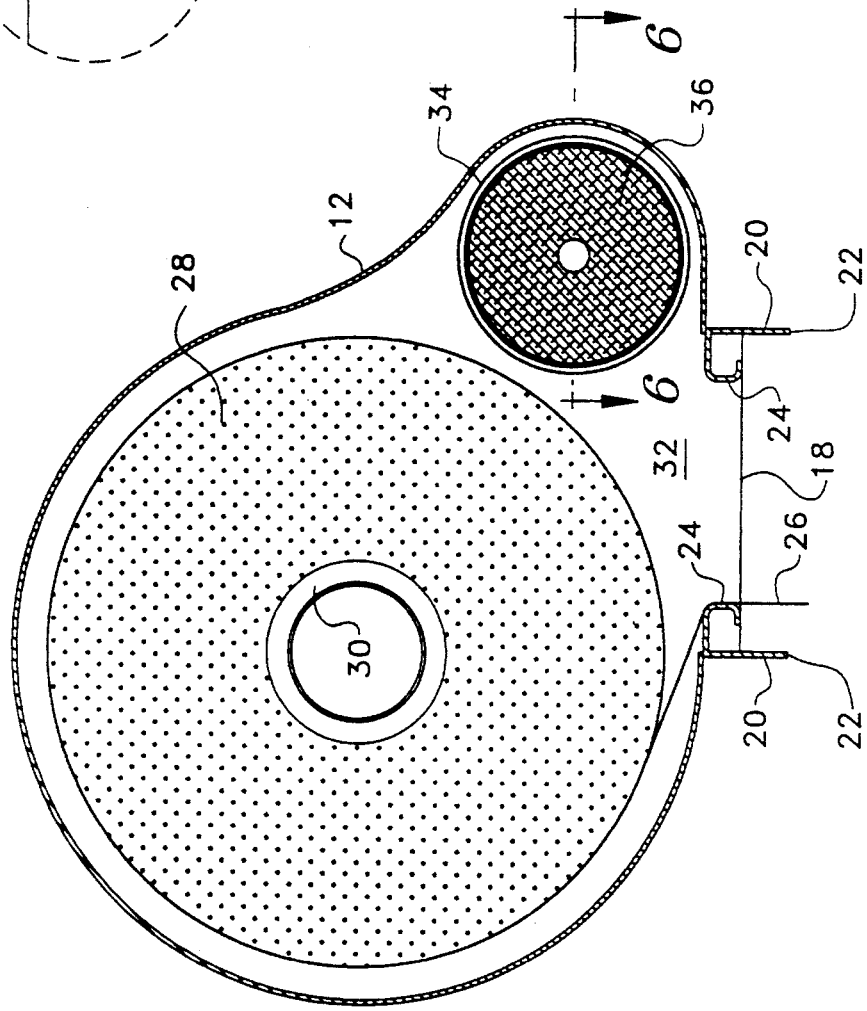
FIG. 5 is a front elevational view of the dispenser of the present invention with the front housing section removed therefrom.

Turning next to FIG. 5, it can be seen that at each end of dispensing opening 18 located between vertical wall sections 20 are positioning members 24. Positioning members 24 ensure that as each of the desired length of tissue is extracted from the dispenser 10 through dispensing opening 18 and severed from the remainder of the web by tearing it across one of the bottom edges 22, the tail 26 of the web will remain spaced away from vertical side wall sections 20 allowing for easier grasping by the user. In addition, positioning members 24 ensure that the tail 26 of the roll of sanitary tissue 28 will hang such that its lower edge will be below bottom edges 22 also facilitating easier grasping by the user.

Roll 28 of sanitary tissue is supported on spindle 30 which projects from rear wall 32. Also projecting from rear wall 32 is a second or sub-compartment 34. Second compartment 34 is preferably cylindrical and provides residence for a roll of wet wipes 36. Roll of wet wipes 36 is a coreless roll wherein a tail (not shown) is pulled from the center of the roll. This is typically referred to as center flow dispensing.

Figure 6A:
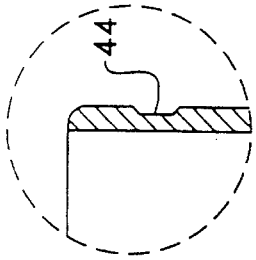
FIG. 6*a* is an enlarged view of that area contained in circle 6*a* of FIG. 6.
Figure 6:
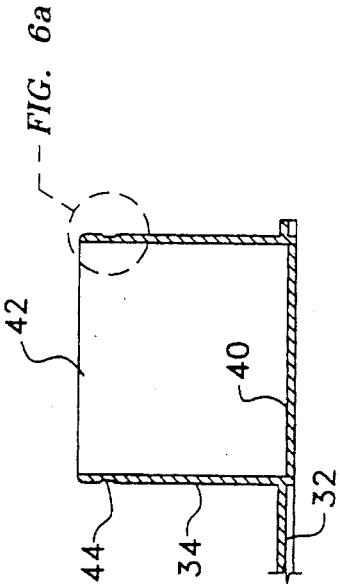
FIG. 6 is a partial sectional view taken along line 6—6 of FIG. 5.
Figure 9:
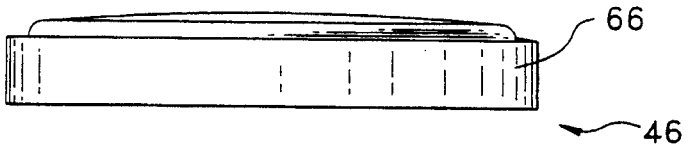
FIG. 9 is a side view of the wet wipe lid with the wet wipe dispensing port snap closure in the closed position.
Figure 8:
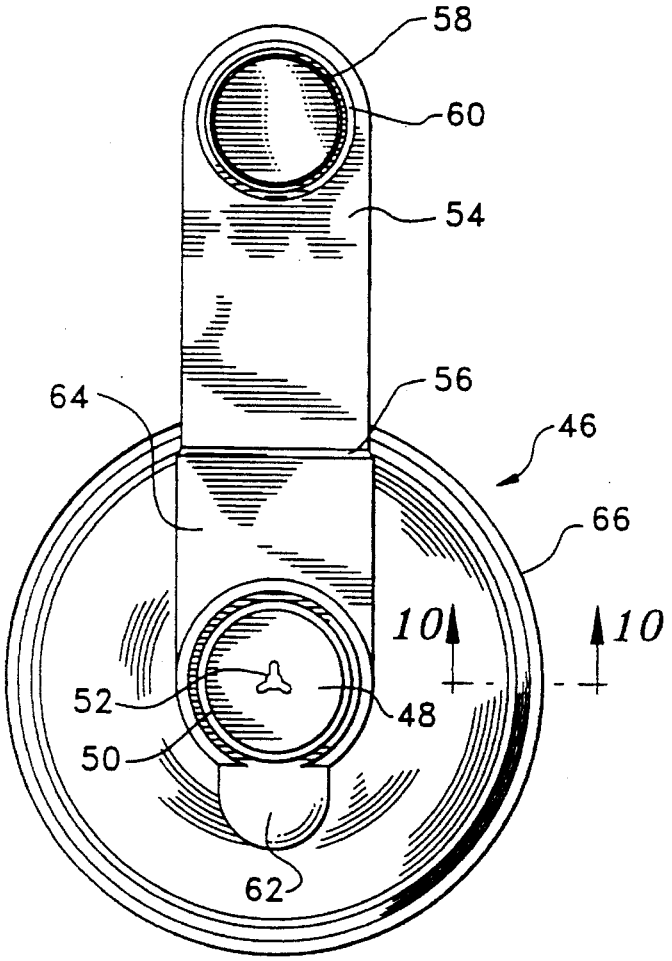
FIG. 8 is a plan view of the wet wipe lid with the wet wipe port snap closure or tongue in the open position.
Figure 10:
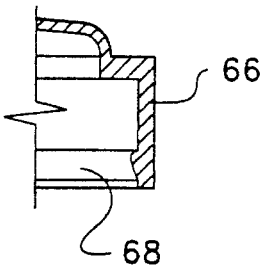
FIG. 10 is a cross sectional view taken along line 10—10 of FIG. 8.

Looking at FIG. 6, it can be seen cylinder 34 includes a closed end 40 and an open end 42. Proximate to open end 42, there is an annular groove 44 in the outside surface of cylinder 34. Annular groove 44 allows for the snap fit of wet wipe lid 46, shown most clearly in FIGS. 8, 9 and 10, onto cylinder 34 providing a substantially liquid tight seal between wet wipe lid 46 and second compartment 34. Wet wipe lid 46 is substantially cylindrical and includes a central depression 48. Projecting upward from central depression 48 is circular rim 50. There is a dispensing port 52 through central depression 48 located inside circular rim 50. Integrally formed with wet wipe lid 46 is tongue 54. Tongue 54 connects to wet wipe lid 46 at hinge 56 allowing tongue 54 to be pivoted toward and away from central depression 48. Projecting from the inside surface of tongue 54 are inner ring 58 and outer ring 60. When tongue 54 is fully closed onto wet wipe lid 46, inner ring 58 and outer ring 60 engage circular rim 50 to form a substantially liquid tight seal therebetween.

A secondary depression 62 is provided in the top surface of wet wipe lid 46 to allow the user to insert a finger therein in close proximity to the distal end of tongue 54 to disengage tongue 54 from rim 50 and allow access to the tail of the roll of wet wipes 36 extending through dispensing port 52. A channel 64 is also provided in the top surface of wet wipe lid 46 in which tongue 54 resides when tongue 54 is closed upon wet wipe lid 46. (The wet wipe lid is shown clearly in U.S. Pat. No. Des. 295,831 which is hereby incorporated by reference herein). Projecting from the inside surface of cylindrical side wall 66 of wet wipe lid 46 is annular seal 68. Annular seal 68 forms a substantially liquid tight seal with cylinder 34 when wet wipe lid 46 is installed on cylinder 34 such that annular seal 68 resides in annular groove 44.

Figure 2:
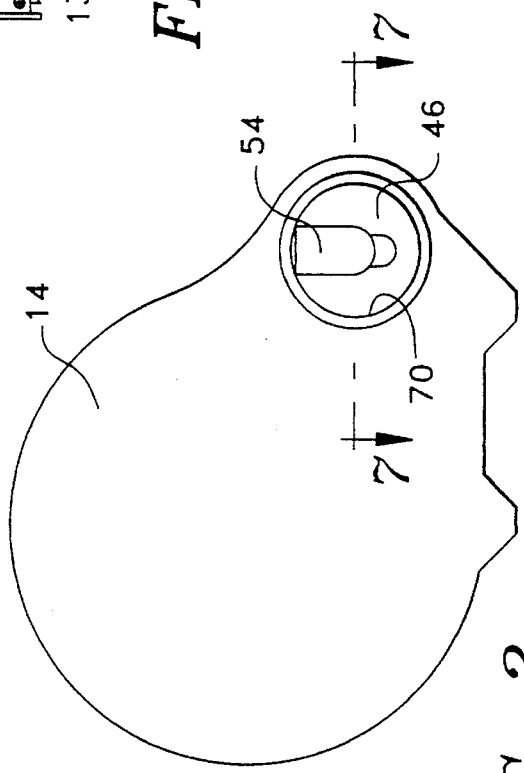
FIG. 2 is a front elevational view of the dispenser of the present invention.
Figure 7:
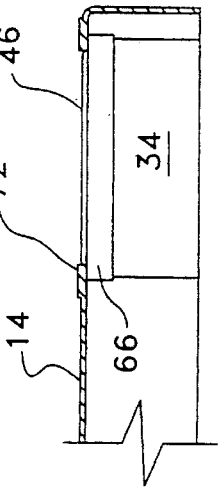
FIG. 7 is a cross-sectional view of the front housing taken along line 7—7 of FIG. 2.

Looking at FIGS. 2 and 7, there is a large orifice 70 through the face of front housing section 14. Large orifice is preferably circular with the center thereof being collinear with the cylindrical axis of second compartment 34. Large orifice 70 has a diameter which is less than the outside diameter of cylinder 34. In such manner, when wet wipe lid 46 is installed upon cylinder 34 and front housing section 14 is closed upon rear housing section 12, a user has access to tongue 54 and the tail of the roll of wet wipes extending through dispensing port 52. However, because the outside diameter of second compartment 34, and therefore the outside diameter of wet wipe lid 46 is greater than the diameter of large orifice 70, wet wipe lid 46 cannot be removed from cylinder 34 while front housing section 14 is closed upon rear housing section 12. In addition, as shown most clearly in FIG. 7, the front wall of front housing section 14 may be provided with a bezel 72 about the periphery of large orifice 70 to provide reinforcement to front housing section 14 and to aid in properly locating lid 46 in orifice 70 when front housing section 14 is in the closed position.

Figure 12:
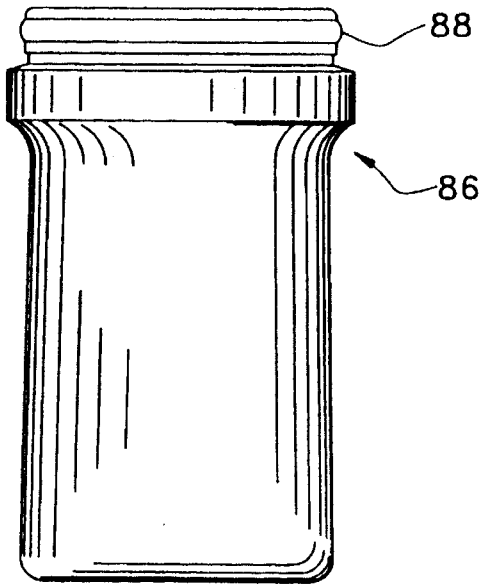
FIG. 12 is an elevational view of a disposable wet wipe container which can be used in conjunction with the alternative embodiment depicted in FIG. 8.
Figure 11:
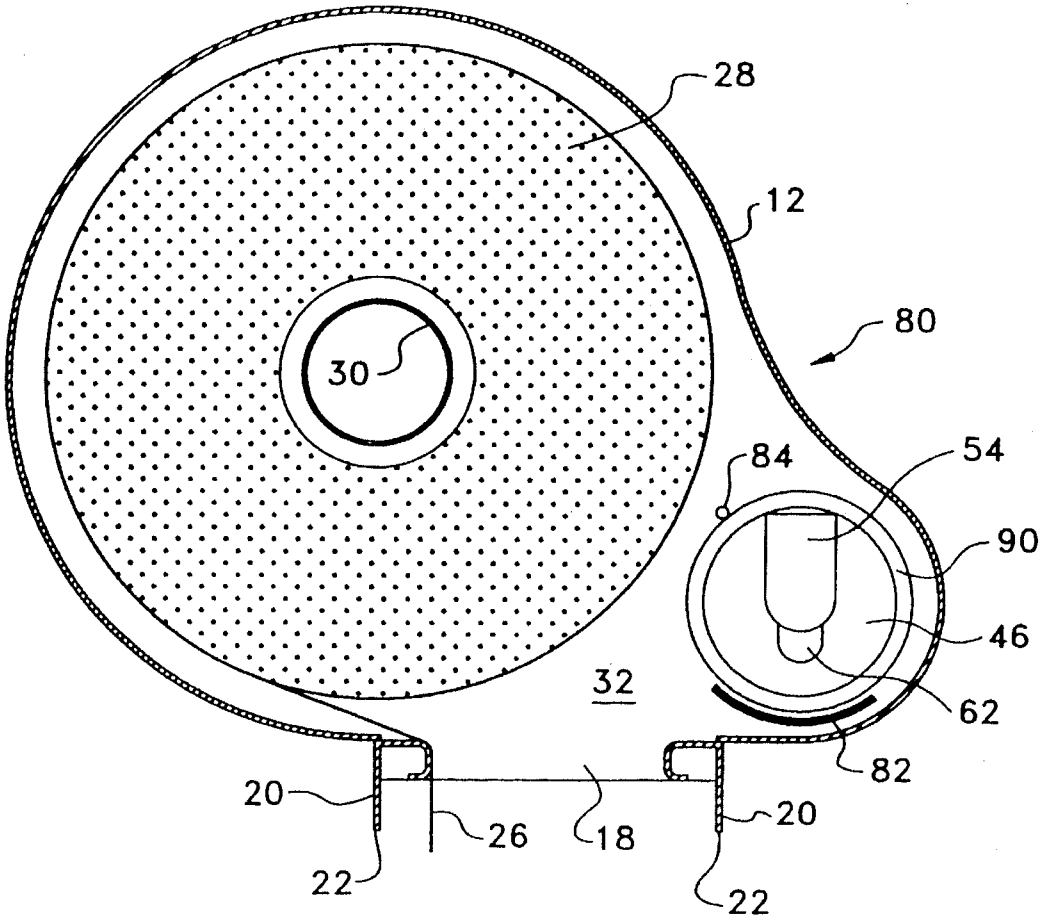
FIG. 11 is a front elevational view of an alternative embodiment of the present invention with the front housing removed therefrom.

Looking next at FIG. 11, there is shown a front elevation of an alternative embodiment 80 of the dispenser of the present invention with the front cover section 14 removed therefrom. In this alternative embodiment dispenser 80, those elements which are identical to the elements depicted in the embodiment discussed above and depicted in FIGS. 1 through 10 are numbered identically. In the alternative embodiment dispenser 80, rather than having a cylinder 34 projecting from rear wall 32, there is a cradle 82 and a post 84 projecting from the rear wall 32. Cradle 82 and post 84 are designed to support and maintain the position of a typical wet wipe dispensing container 86 as depicted in FIG. 12. The wet wipe lid 46 would mount directly to container 86 with cradle 82 supporting the container such that it aligns substantially with large orifice 70 when front housing section 14 is closed upon rear housing section 12. Post 84 ensures that container 86 cannot be moved laterally within the dispenser such that it cannot be moved toward the dispensing opening 18. Container 86 includes an annular seal 88 which allows for a snap fit with lid 46 when lid 46 is installed on container 86. Those skilled in the art will recognize that cradle 82 can be replaced with other types of supports such as additional posts projecting from the rear housing 12.

Access to the interior of the dispensers 10, 80 requires a key in order to remove front housing section 14 from rear housing section 12. In such manner, theft of entire rolls of dry tissue and wet wipes is obviated. In addition, access by a user to the wet wipes other than through the dispensing of individual sheets is prevented. Because such access is prevented, users should view the wet wipe web contained therein to be less likely to have been contaminated by prior users, and further, less likely to have been tampered with by prior users.

It will be recognized by those skilled in the art that the lid 46 can be integrally formed with the front housing section 14. However, this would not be a preferred structure. Further, in each of the embodiments described herein, it would be preferable that each roll of wet wipes be supplied with a new lid 46. This will promote a more sanitary appearance to the dispenser and, therefore promote acceptability and use.

From the foregoing, it will be seen that this invention is one well adapted to attain all of the ends and objects hereinabove set forth together with other advantages which are inherent to the apparatus.

It will be understood that certain features and subcombinations are of utility and may be employed with reference to other features and subcombinations. This is contemplated by and is within the scope of the claims.

As many possible embodiments may be made in the invention without departing from the scope thereof, it is to be understood that all matter herein set forth and shown in the accompanying drawings is to be interpreted as illustrative and not in a limiting sense.

What is claimed:

1. A combined dry sanitary tissue and pre-wetted personal hygiene wipe dispenser comprising:

(a) a housing including a rear housing section and a front housing section, said front housing section pivotally connected to said rear housing section such that said front housing can pivot to a relative open position and a relative closed position in relation to said rear housing section, thereby allowing access to said dry sanitary tissue when said front housing section is in the open position, said rear housing section including a rear wall, said front housing section and said rear housing section defining a primary compartment for receiving a roll of dry sanitary tissue when said front housing section is in the closed position, said primary compartment having an opening through which the dry sanitary tissue is dispensed;

(b) spindle means projecting from said rear wall for supporting said roll of dry sanitary tissue in said primary compartment;

(c) wall means projecting from said rear wall to form a second compartment for supporting a roll of pre-wetted personal hygiene wipes therein, wherein said spindle means and said wall means are substantially parallel such that the cylindrical axis of said roll of dry sanitary tissue and said roll of pre-wetted personal hygiene wipes are maintained substantially parallel to one another, said second compartment having an open distal end through which the pre-wetted personal hygiene wipes are dispensed; and (d) lid means for forming a liquid tight seal over said open distal end, said lid means engagable and disengagable from said open distal end, said lid means including a dispensing port therethough through which the prewetted personal hygiene wipes are dispensed, said lid means remaining engaged with said open distal end when said front housing section is in the closed position.

2. A combined dry sanitary tissue and prewetted personal hygiene wipes dispenser comprising:

(a) a housing including a rear housing section and a front housing section, said front housing section having a relative open position and a relative closed position in relation to said rear housing section, said front housing section removably connected to said rear housing section such that said front housing can be removed from said rear housing section to the open position to gain access to said roll of dry sanitary tissue and returned the closed position, said rear housing section including a rear wall, said rear housing section and said front housing section defining a primary compartment for receiving a roll of dry sanitary tissue when said front housing section is in the closed position, said primary compartment having an opening through which the dry sanitary tissue is dispensed;

(b) spindle means projecting from said rear wall for supporting the roll of dry sanitary tissue in said primary compartment;

(c) wall means projecting from said rear wall to form a second compartment for supporting a roll of prewetted personal hygiene wipes therein, said second compartment having an open distal end through which said personal hygiene wipes are dispensed;

(d) lid means for forming a liquid tight seal over said open distal end, said lid means engagable with and disengagable from said open distal end, said lid means including a dispensing port therethrough through which the prewetted hygiene wipes are dispensed, said lid means remaining engaged with said open distal end when said front housing section is in the closed position on said rear housing section.

3. A combined dry sanitary tissue and prewetted personal hygiene wipes dispenser as recited in claim 2 further comprising:

an orifice through said front housing section providing access to said dispensing port in said lid means when said front housing section is closed on said rear housing section so that the roll of prewetted personal hygiene wipes is dispensable through said dispensing port and said orifice.

4. A combined dry sanitary tissue and prewetted personal hygiene wipes dispenser comprising:

(a) a housing including a rear housing section and a front housing section, said front housing section removably connected to said rear housing section substantial said front housing section is movable from an open position to a closed position in relation to said rear housing section, said front housing section and said rear housing section forming a compartment for receiving a roll of dry sanitary tissue when said front housing section is in said closed position, said compartment having an opening through which the dry sanitary tissue is dispensed;

(b) means for supporting a roll of dry sanitary tissue in said compartment;

(c) means for supporting a roll of prewetted personal hygiene wipes in said compartment;

(d) container means for holding said roll of prewetted personal hygiene wipes in said compartment, (e) lid means for forming a liquid tight seal with said container means, said lid means being engagable and disengagable with said container means, said lid means including a dispensing port therethrough which the prewetted personal hygiene wipes are dispensed, said lid means remaining engaged with said container means when said front housing is in the closed position; and (f) an orifice through said front housing section allowing access to said dispensing port in said lid means when said front housing section is in said closed position so that the roll of prewetted personal hygiene wipes is dispensable through said dispensing port and said orifice.

5. A combined dry sanitary tissue and prewetted personal hygiene wipes dispenser as recited in claim 4 further comprising:

locking means for locking said front housing in said closed position.

6. A combined dry sanitary tissue and prewetted personal hygiene wipes dispenser as recited in claim 4 wherein:

said front housing section is pivotally connected to said rear housing section.

7. A combined dry sanitary tissue and prewetted personal hygiene wipes dispenser as recited in claim 4 wherein:

said means for supporting said roll of prewetted personal hygiene wipes includes an arcuate wall extending from a rear wall of said rear housing section.

8. A combined dry sanitary tissue and prewetted personal hygiene wipes dispenser as recited in claim 4 wherein:

said means for supporting said roll of prewetted personal hygiene wipes is affixed to a rear wall of said rear housing section.

9. A combined dry sanitary tissue and prewetted personal hygiene wipes dispenser as recited in claim 4 wherein:

said means for supporting said roll of prewetted personal hygiene wipes is at least one support member within said compartment extending from said rear housing section.

10. A combined dry sanitary tissue and prewetted personal hygiene wipes dispenser as recited in claim 4 further comprising:

a bezel surrounding said orifice to assist in positioning said lid means when said front housing section is in said closed position.

11. A combined dry sanitary tissue and prewetted personal hygiene wipes dispenser as recited in claim 4 further comprising:

at least one tearing edge extending from said rear housing section for tearing off a dispensed section of said roll of dry sanitary tissue.

12. A combined dry sanitary tissue and prewetted personal hygiene wipes dispenser as recited in claim 4 further comprising:

(a) an annular groove in said container means, said container means having a proximal end which is positioned adjacent to said rear wall and a distal end which is open, said annular groove being proximate to said distal end;

(b) a ring projecting from said lid means, said ring residing in said annular groove when said lid is installed on said container means to form a liquid tight seal therewith.

13. A combined dry sanitary tissue and prewetted personal hygiene wipes dispenser as recited in claim 4 wherein:

said orifice in said housing section is in a vertical wall thereof.

* * * * *